US005487714A

United States Patent [19]

Ferrari

[11] Patent Number: 5,487,714

[45] Date of Patent: Jan. 30, 1996

[54] EXERCISE MACHINE WITH ENCLOSED RESISTANCE ASSEMBLY

[75] Inventor: Carlo Ferrari, Alicante, Spain

[73] Assignee: Weider Health and Fitness, Inc., Woodland Hills, Calif.

[21] Appl. No.: 155,008

[22] Filed: Nov. 19, 1993

[51] Int. Cl.[6] ..... A63B 21/02

[52] U.S. Cl. ..... 482/123; 482/121; 482/129; 482/130

[58] Field of Search ..... 48/121, 129, 130, 48/133, 142, 123

[56] References Cited

U.S. PATENT DOCUMENTS

| | | | |
|---|---|---|---|
| 254,108 | 2/1882 | Bryon | 482/129 |
| 655,671 | 8/1900 | Crooker et al. | 482/121 |
| 1,902,694 | 3/1933 | Edwards . | |
| 3,428,312 | 2/1969 | Machon | 482/130 |
| 3,638,941 | 2/1972 | Kulkens . | |
| 3,966,182 | 6/1976 | Stadelmann et al. . | |
| 4,033,580 | 7/1977 | Paris . | |
| 4,072,309 | 2/1978 | Wilson . | |
| 4,154,441 | 5/1979 | Gajda . | |
| 4,227,689 | 10/1980 | Keiser . | |
| 4,257,593 | 3/1981 | Keiser . | |
| 4,275,882 | 6/1981 | Grosser et al. . | |
| 4,384,715 | 5/1983 | Savio et al. | 482/129 |
| 4,428,578 | 1/1984 | Kirkpatrick | 482/129 |
| 4,492,375 | 1/1985 | Connelly . | |
| 4,566,691 | 1/1986 | Mahnke . | |
| 4,582,319 | 4/1986 | Luna | 482/130 |
| 4,582,320 | 4/1986 | Shaw . | |
| 4,603,857 | 8/1986 | Chipman et al. | 482/129 |
| 4,618,140 | 10/1986 | Brown . | |
| 4,796,881 | 1/1989 | Watterson . | |
| 4,830,365 | 5/1989 | March | 482/129 |
| 4,921,242 | 5/1990 | Watterson . | |
| 5,005,831 | 4/1991 | Hara | 482/129 |
| 5,037,090 | 8/1991 | Fitzpatrick . | |
| 5,044,633 | 9/1991 | Rice | 482/130 |
| 5,080,353 | 1/1992 | Tench | 482/130 |
| 5,284,464 | 2/1994 | Lee, III et al. | 482/121 |

FOREIGN PATENT DOCUMENTS

| | | |
|---|---|---|
| 1081419 | 7/1953 | France . |
| 1468194 | of 1967 | France . |
| 2416700 | 9/1979 | France . |
| 2225342 | 12/1973 | Germany . |
| 650009 | 2/1951 | United Kingdom . |
| 1169148 | 10/1969 | United Kingdom . |

OTHER PUBLICATIONS

Owner's Manual entitled "Home Gymnasium Executive" in English and in Dutch–6 pages (Approx. 1980).

Abstract of South African Patent dated Sep. 10, 1978.

*Primary Examiner*—Richard J. Apley
*Assistant Examiner*—Jerome Donnelly
*Attorney, Agent, or Firm*—Trask, Britt & Rossa

[57] ABSTRACT

A resistance assembly (13) is disclosed for use in an exercise apparatus having a movable element (18) connected to a progressively increasing resistance assembly (13) by a cable (34). An exercise machine (10) employing the resistance assembly (13) is of a multipurpose type comprised of a frame (12) having an upright member (26) with a backrest (32) and a seat (30) attached thereto. The movable element (18) is operably associated with the frame (12) for movement by a user in performance of exercises resisted by an attached elastic resistance member (16). The elastically responsive resistance member (16) is selectively secured at one end to the upright member (26) to be positionable at one of a plurality of positions. A biasing device (20) to bias the force exerted by the resistance member (16) on the movable element (18) is accessible to a user in a seated position. To protect against injury in the event of breakage, the resistance member (16) is positioned in an enclosure (14) having both an outer sleeve (42) that is fixed to the frame (12) and an extendible inner sleeve (44). The inner sleeve (44) is secured to one end of the resistance member (16) and is attached by the biasing device (20) to the frame (12). The frame (12) is preferably provided with pulleys (38) and a cable (34) in a system to permit numerous exercising stations and associated movable elements (18) to access the resistance member (16).

7 Claims, 4 Drawing Sheets

EXERCISE MACHINE WITH ENCLOSED RESISTANCE ASSEMBLY

BACKGROUND OF THE INVENTION

1. Technical Field of the Invention

This invention relates to exercise machines, and more particularly, to resistance members for resisting movement of components on a multipurpose exercise machine.

2. Background Art

Exercise apparatus exist in many configurations. Typically each configuration is intended to exercise certain muscle groups of the body by moving a member of the body in a specific way or through a selected range of motions, usually intended to represent an athletic activity or otherwise physiologically beneficial motion. The member of the body typically works against a resistance as it moves through the desired motion.

Dead weights, also called free weights, such as dumbbells and barbells, have been used for progressive resistance exercises. More recently, other forms of resistance equipment have used friction pads, springs, flexible bands or hydraulic cylinders. These forms of resistance can be cumbersome to use and may not represent a preferred resistance through an entire range of motions or for different exercises using the same resistance.

It is presently believed that a substantial resistance is desirable at initial deflection, i.e., the start of an exercising motion by a user. An increase of resistance during the exercising motion is also desirable. It is further believed that a nearly ideal resistance plot or curve (of resistance verses deflections) would be biased upward to have a pre-selected non-zero value immediately upon deflection by a user, followed by a tailored linear increase in resistance up to maximum deflection.

Thus, it is desirable to have a resistance device that can be pre-loaded to provide resistance immediately upon deflection by a user. It is also desirable that the force curve of such a device be curved upward in proportion to the amount of preloaded resistance. Optimum resistance force over the entire range of motion is then available.

Prior art devices, such as springs and hydraulic cylinders, do not meet this need. For instance, a conventional spring mechanism may not provide a high level of initial resistance and may not display linear resistance through the full range of travel. In addition, a spring having a high spring constant may result in an unacceptable high level of maximum resistance. Hydraulic shock systems fail to meet the needs described above because they typically cannot be preloaded and do not provide an increase in resistance throughout the range of motion or deflection. Further, the heating of the fluid with repetitions can affect resistance.

If one were to select an elastomeric resistance, it may break more readily than other resistance devices and also become entangled in the equipment. One proposed method for dealing with breakage is to include a mechanism to retain or contain the elastomeric elements. However, such a capture mechanism must be moved whenever the elastomeric element is moved to adjust the level of resistance. In addition, the elastomeric element cannot be removed for adjusting resistance if it is pre-loaded.

Consequently, there is a need for a resistance device that can be easily biased at initial deflection and is conveniently adjustable by the user without requiring the user to leave the machine or change position. In addition, such a device would be properly restrained should breakage occur.

SUMMARY OF THE INVENTION

In accordance with the present invention, a resistance assembly for providing resistance in an exercise machine is provided. The machine includes a frame and movable element operably associated with the frame for movement by a user. The resistance assembly comprises a resistance device for elastically resisting deflection of the movable element by the user, an adjustment device for adjusting resistance levels, and an enclosure for the resistance device.

In accordance with another aspect of the present invention, the enclosure comprises a sleeve that is telescopically extended over the resistance device. The sleeve includes an outer sleeve attached to the frame and an inner sleeve attached to the resistance device to move extendably with the resistance device.

In accordance with another aspect of the present invention, the resistance assembly includes a handle connected to the inner sleeve and positioned for grasping by a user, and an engagement member attached to the inner sleeve and selectively engaging the frame to set the resistance device at an initial pre-loaded resistance.

In accordance with yet another aspect of the present invention, the resistance assembly also includes an actuator connected to the second end of the resistance device for deflecting the second end of the resistance device between a minimum displacement position and a maximum displacement position.

In accordance with still another aspect of the present invention, the resistance assembly also includes a handle attached to the resistance device and positioned to be accessible to a user on the frame in an exercising position. The handle is operably connected to one end of the resistance device and a cable attaches the other end of the resistance device to the frame to enable selective adjustment of the tension exerted by the resistance assembly by a user in a seated position.

As will be readily appreciated from the foregoing, the present invention permits a user to adjust the tension from a seated position. The force exerted by the resistance member can be adjusted to provide a non-zero initial resistance to motion of a user, which resistance force further increases with extension of the resistance member. Protection is afforded by the enclosure surrounding the resistance member, which also simplifies operation of the biasing device.

DETAILED DESCRIPTION OF THE ILLUSTRATED EMBODIMENTS

Figure 1:
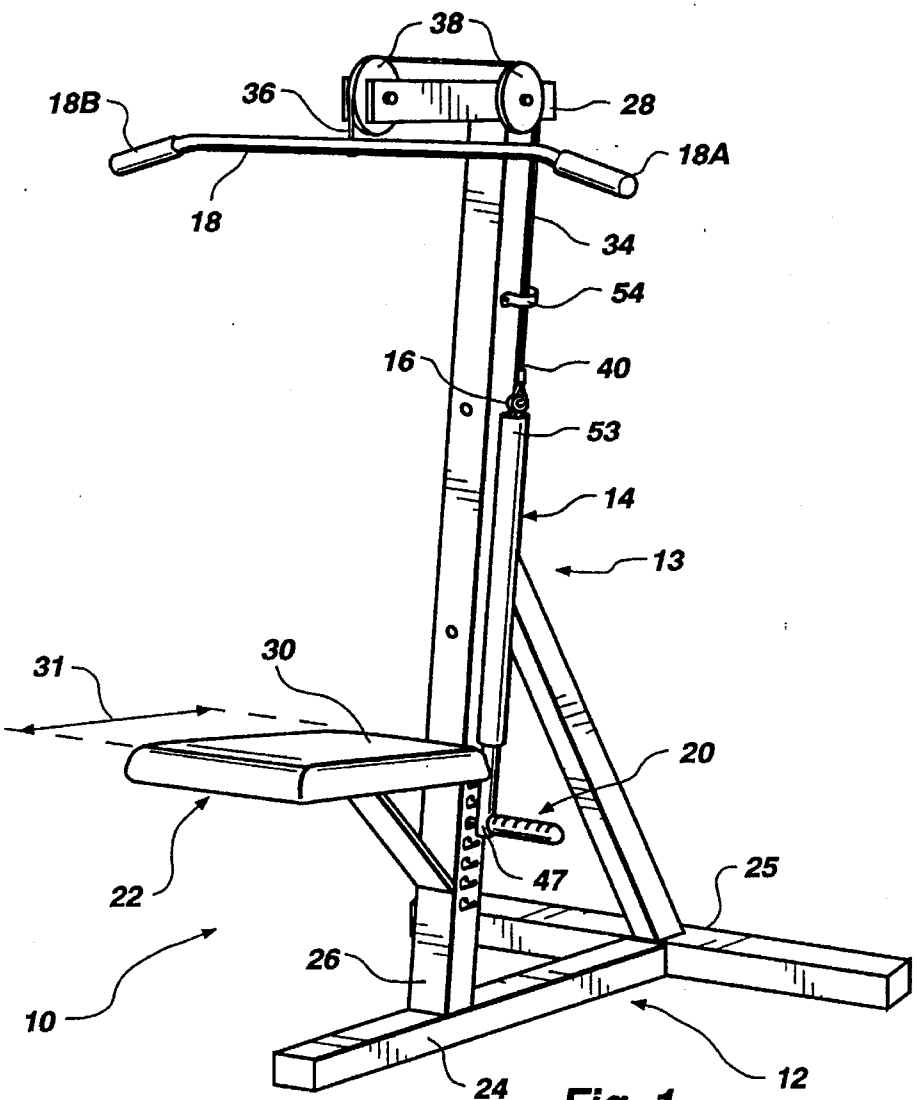
FIG. 1 is an isometric view of an exercise apparatus formed in accordance with the present invention.

The present invention centers on an exercise machine having a moveable member with a resistance device interconnected to resist movement by the user in performing exercises. A wide variety of bench machines, rowers, steppers and the like may all have moveable elements with a resistance to oppose movement of the moveable element. The illustrated embodiment, and, more particularly, the exercise machine 10 of FIG. 1, is a machine that may be referred to as a home gym. It is used to illustrate the principles of the invention.

Referring to FIG. 1, an exercise machine 10 has a frame 12 and a resistance assembly 13 connected thereto. The resistance assembly 13 includes an enclosure 14 that substantially surrounds a resistance member 16. A movable element 18 connects to the resistance member 16 to enable a user to extend one end of the resistance member 16. A biasing device 20 is attached to the enclosure 14 that is adjustable to bias or adjust the tension of the resistance member 16 before operation of the moveable element 18. A seat 22 supports a user on the exercise machine 10 during exercising.

The frame 12 is preferably formed of tubular metal such as steel having a rectangular cross section. The frame 12 has a first base 24 with a cross member 25 secured thereto to form a "T" base. Other configurations of a base may be selected as desired. The base 24 rests on a surface directly or through feet if desired. The frame also includes an upright 26 that extends upwardly from base 24 to a cross member 28 thereabove. The exercise machine 10 may include multiple cross members 28, uprights 26, bases 24 and so forth, as needed for the particular exercises for which the exercise machine 10 is designed. Similarly, a seat 22 may be attached or removeably attached to the frame 12 at various locations to create multiple stations for exercising.

Figure 2:
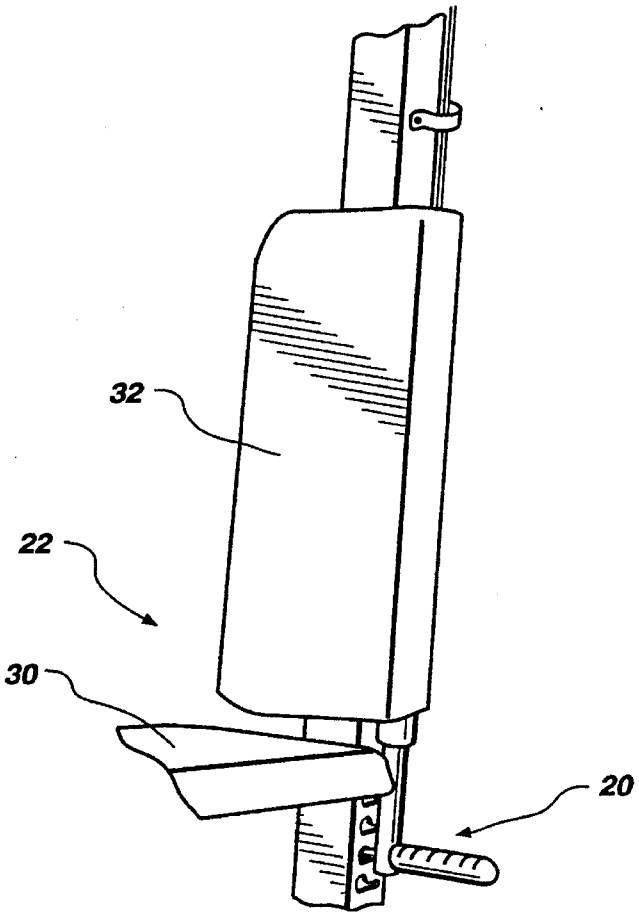
FIG. 2 is a partial isometric view of the exercise apparatus of FIG. 1 illustrating the position of the enclosure and seat.

The seat 22 is preferably comprised of a seat member 30 and a back rest 32, as shown in FIG. 2, for supporting a user during exercising. The seat member 30 may extend a short distance 31 from the frame 12 for sitting exercises. Alternately, it may be extended in length 31 to form a bench for performing exercises when prostrate or prone.

The movable element 18 is here shown as an overhead pull bar with handgrips 18A and 18B at its opposite ends. The bar 18 is secured to a cable 34 at a distal end 36 thereof. The cable 34 is reeved over two pulleys 38 that are rotatably attached to the frame 12 and, more particularly, to the cross member 28 to direct the tension between the movable element 18 attached at the distal end 36 and the resistance member 16 attached to a proximal end 40 of the cable 34. More than one cable 34 may be use by adding suitable connections and additional pulleys 38. Also, the pulleys 38 can be arranged in a block-and-tackle configuration to alter the mechanical advantage between the resistance member 16 and the movable element 18.

Figure 3:
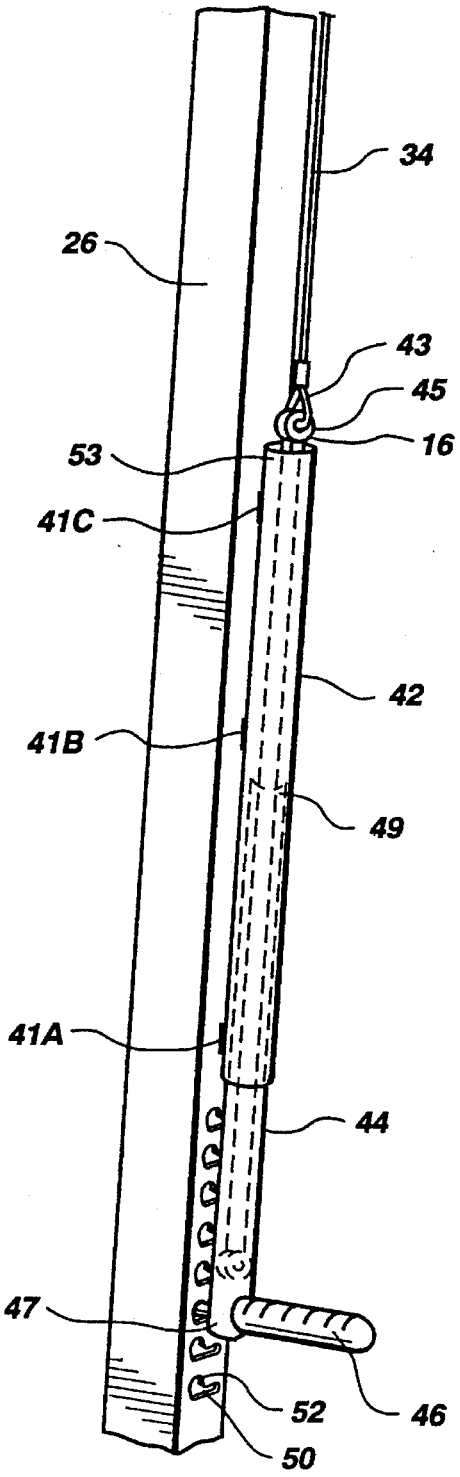
FIG. 3 is an isometric view of a portion of the exercise apparatus of FIG. 1 illustrating a biased position of the resistance member in the enclosure.

The enclosure 14 is illustrated in greater detail in FIG. 3. As shown therein, it has an outer sleeve 42 fixed to the upright 26 of the frame 12 by any suitable means including clamps, welding and the like. In the embodiment of FIG. 3, slots 41A, 41B, and 41C in the upright 26 receive fingers (not shown) attached to the outer sleeve 42. An inner sleeve 44 is movably but snugly positioned within the outer sleeve 42 to extend therefrom. Within the enclosure 14, one end 43 of the resistance member 16 is attached to the inner sleeve 44. The resistance member 16 is connected proximate its other end 45 to the cable 34.

Figure 7:
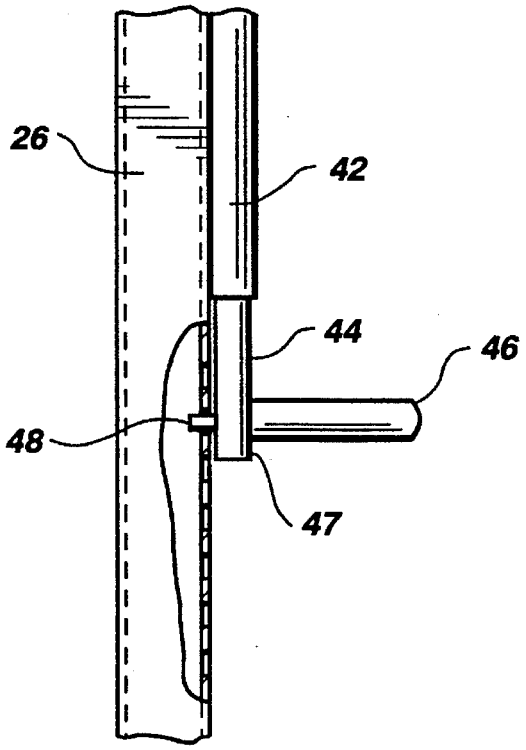
FIG. 7 is a front view of the enclosure illustrated in FIG. 5.
Figure 8:
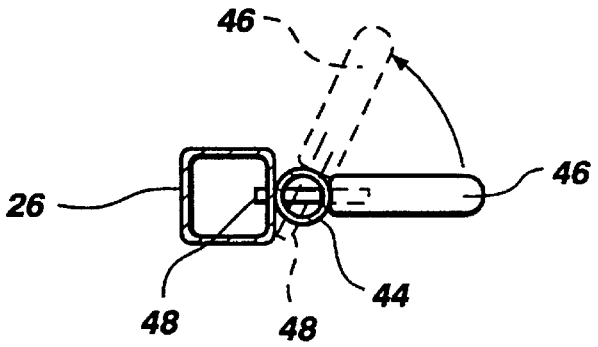
FIG. 8 is a top view of the frame, the inner sleeve of the enclosure, and the handle of the exercise apparatus illustrated in FIG. 1.

The biasing device 20 is comprised of a handle 46 and pin 48 attached to enclosure 14. In this embodiment, it is attached to one end 47 of the inner sleeve 44, as shown in greater detail in FIGS. 7 and 8. The other end 49 of the inner sleeve 44 is free to snugly and slidably move within outer sleeve 42. The pin 48 is configured to adjustably lock into any one of a plurality of slots 50 formed in the upright 26 on the frame 12. Each of the plurality of slots 50 are formed with means for preventing unintentional release of the biasing device. In the embodiment shown, the pin 48 is sized to slidably enter the slot 51 and to lock securely in detent 52 absent purposeful disengagement by a user.

In an alternative embodiment, the enclosure 14 may be configured to retain the resistance member 16 along any member of the frame 12. For example, the cross-member 28 may hold the enclosure 14 in a horizontal position suitable for operation of the biasing device 20 by a user who is in an exercising position on the exercise machine 10.

Figure 4:
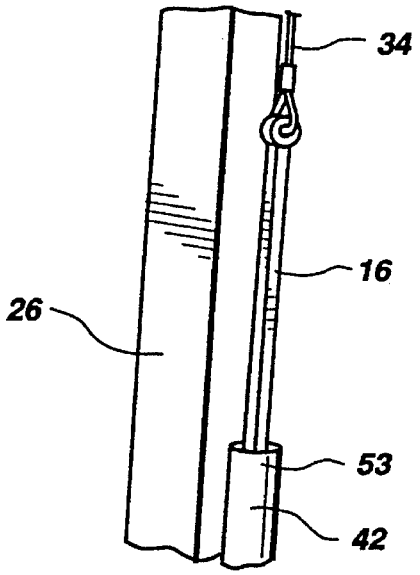
FIG. 4 is an isometric view of the upper end of the resistance member of FIG. 3 in an extended position.
Figure 5:
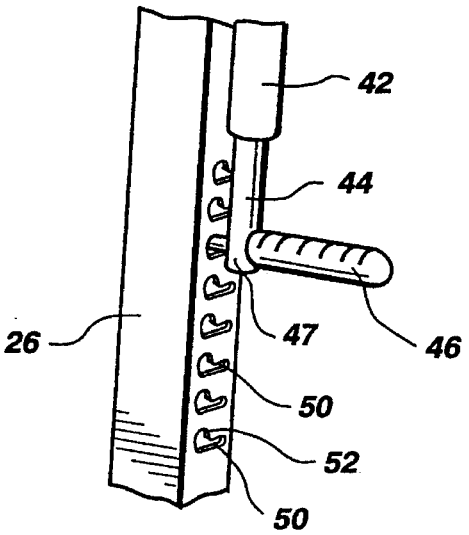
FIG. 5 is an isometric view of the lower end of the enclosure of FIG. 4.
Figure 6:
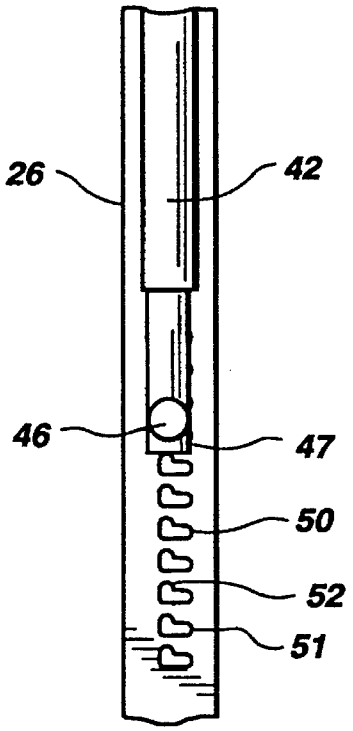
FIG. 6 is a side view of the enclosure illustrated in FIG. 5.

Referring first to FIGS. 4 and 5, the exercise machine 10 is adjusted by moving the handle 46 to place the pin 48 in a selected slot 50 on the upright 26 and then into its related detent 52. The user may grasp the handle and move by hand. Alternately, the user here can use a foot to move the handle 46. Alternate means may be used to attach the end 47 of the biasing means to the frame 12 and provide for adjustability, either manually or even electrically.

In operation, the resistance member 16 is extended as inner sleeve 44 is drawn by the handle 46 out of the outer sleeve 42 to extend along the upright 26. The resistance member 16 is therefore pre-stretched and thus pre-loaded, biasing the tensile force that is exerted on cable 34. Upon movement of the movable element 18 (shown in FIG. 1), the initial resistance to movement is equal to the bias force or pre-load imposed by the biasing device 20 on the resistance member 16. FIG. 3 shows the inner sleeve 44 in a more biased position relative to the less biased position in FIG. 5.

In the at-rest position, the resistance member 16 may extend out of the top end 53 of the outer sleeve 42 as shown. In other configurations, a longer outer sleeve 42 may be provided to enclose a portion of the cable 34 and all of the resistance member 16 at all times. Thus in use, the resistance member 16 will be within the sleeve 42 even when extended. In yet another alternate arrangement, the sleeve 42 can be secured to the end 43 of cable 34 or the end of the resistance member 16 and move therewith. In such an embodiment, the inner sleeve 44 is suitably lengthened to allow for greater relative movement of the inner sleeve 44 and the outer sleeve 42. In some situations, the user may release the moveable element 18 with considerable tension (stored potential energy) in the resistance member 16. In turn, the resistance member 16 will travel toward a relaxed position and impart some inertial to cable 34. To inhibit movement of the cable 34 away from the pulleys 38 and away from upright 26, means to retrain and guide the cable 34 are provided.

In the illustrated embodiment, the retainer 54 guides the cable 34 and retains it in general alignment with the upright 26. Further, a separation of the resistance member at a point spaced away from the end 45 may impart some potential energy upward to the cable 34. Retainer 54 would thereby function to retain the cable 34 away from interfering with other components, from contact with the user, or from movement away from the upright 26.

Figure 9:
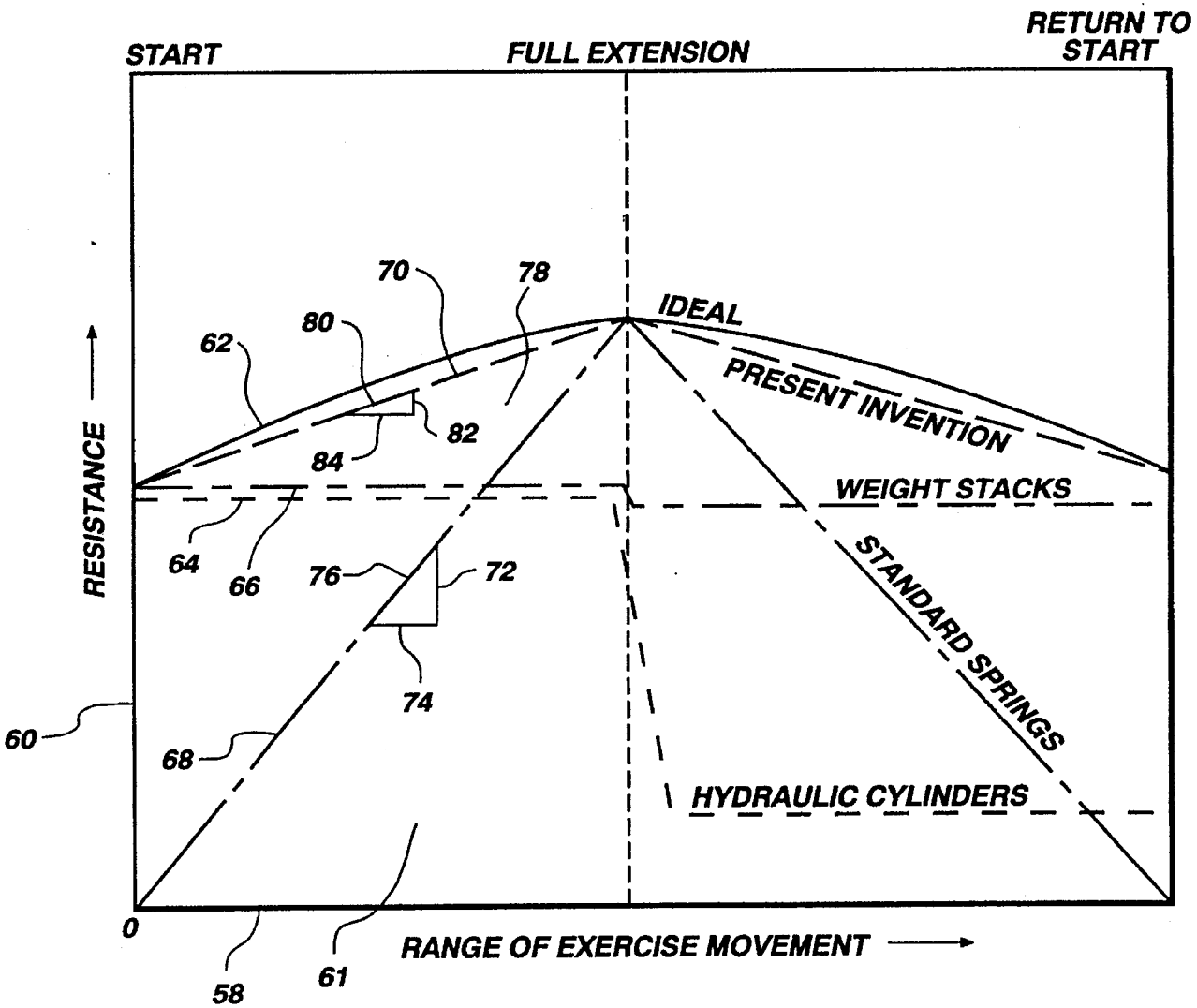
FIG. 9 is a chart comparing plots of force as a function of deflection for several resistance devices.

A benefit of the instant invention may be observed by reference to the graphs of FIG. 9. Horizontal axis 58 represents movement (distance) by a user through the entire range of motion of an exercise. The vertical axis 60 represents the resistance force exerted by the resistance mechanism under consideration. The theoretical energy usage of a user is the area 61 under a curve. The ideal weight or resistance would theoretically result in the curve 62. By contrast, the characteristic of hydraulic one-way cylinders is represented by the curve 64. Conventional weight stacks are represented by the curve 66. A conventional spring not pre-loaded (biased) results in the characteristic of the curve 68.

In comparison, the curve 70 shows the characteristic of the instant invention approaching the total energy (enclosed area) of the ideal of the curve 62. The rise 72 of any curve (curve 68 is used as example in FIG. 9) in the direction of the vertical axis 60 divided by the run 74 of the same curve in the direction of the horizontal axis defines the slope 76 of the curve.

A machine configured in accordance with the instant invention so that the resistance member 16 is biased will yield a curve such as curve 70 with a large energy (area 78) under the curve 70. The curve 70 has a moderate slope 80 due to a modest rise 82 in force (vertical axis 60) in relation to the long run 84 in distance of motion (horizontal axis 58). However, the slope 80 can be adjusted by varying the amount of bias imposed on the resistance member 17.

While a preferred embodiment of the invention has been illustrated and described, it is to be understood that those skilled in the art will see obvious variations that rely on the essential elements of the invention. Therefore, the foregoing description is not intended to limit the scope of the invention which is defined by the claims that follow.

The embodiments of the invention in which an exclusive property or privilege is claimed are defined as follows:

1. An exercise machine comprising:

a frame;

a movable element operably associated with said frame for movement relative to said frame by a user in the performance of exercise;

resistance means having a first end and a second end, said second end being connected to said movable element, said resistance means having an elastically deformable element extending between said first end and said second end to resist movement of said movable element;

biasing means adapted to said resistance means proximate said first end for adjustably tensioning said resistance means, said biasing means including a handle for grasping by a user to move said first end relative to said frame, said biasing means having first means for removable connection to said frame;

second means associated with said frame for removably interconnecting said first means and said second means at a selected location of a plurality of locations on said frame to adjust the tensioning of said resistance means; and enclosure means connected to said frame for substantially enclosing said elastically deformable element, said enclosure means including;

an outer sleeve member attached to said frame with said elastically deformable element substantially therewithin, and an inner sleeve attached to said resistance means proximate said first and to enclose a portion of said resistance means therewithin, said inner sleeve being sized to telescope into said outer sleeve.

2. The exercise machine of claim 1, wherein said first means includes a member extending away therefrom, and wherein said second means includes a plurality of apertures formed spaced apart from each other in said frame and sized to removably receive said member for attaching said resistance means to said frame at a preselected location.

3. The exercise machine of claim 2, wherein each aperture includes a detent for removably locking said member therein.

4. The exercise machine of claim 3, wherein said frame includes an upright member with a seat to receive a user thereon for the performance of exercise.

5. The exercise machine of claim 4, wherein said elastically deformable element is made of an elastomeric material.

6. An exercise machine comprising:

a frame for positioning on a support surface, said frame having an upright member extending upwardly from said support surface;

user support means attached to said frame for supporting a user thereon in the performance of exercises;

a movable element operably associated with said frame and configured for operation by a user positioned on said user support means;

resistance means having a first end and a second end, said second end being connected to said movable element, said resistance means having an elastically deformable element extending between said first end and said second end to resist movement of said movable element;

a plurality of apertures formed in said upright member spaced from each other;

connecting means attached to said resistance means proximate said first end to connect to a selected aperture of said plurality of apertures;

a handle attached to said second end for operation by a user for movement of said connecting means to a selected aperture to pretension said elastically deformable element to vary the resistance to movement of said movable element; and enclosure means connected to said frame for substantially enclosing said elastically deformable element, said enclosure means including:

an outer sleeve member attached to said frame with said elastically deformable element substantially therewithin, and an inner sleeve attached to said resistance means proximate said first and to enclose a portion of said resistance means therewithin, said inner sleeve being sized to telescope into said outer sleeve.

7. The exercise machine of claim 6, further including enclosure means to enclose said elastically deformable element.

* * * * *